United States Patent [19]

Kawasaki et al.

[11] Patent Number: 4,484,703

[45] Date of Patent: Nov. 27, 1984

[54] METHOD FOR MANUFACTURING A BOX-SHAPED DOOR

[75] Inventors: Isamu Kawasaki; Takakazu Hamazaki, both of Oosaka, Japan

[73] Assignee: Tokyo Shibaura Denki Kabushiki Kaisha, Japan

[21] Appl. No.: 420,840

[22] Filed: Sep. 21, 1982

[30] Foreign Application Priority Data

Nov. 13, 1981 [JP] Japan ..... 56-182605

[51] Int. Cl.[3] ..... B23K 31/02

[52] U.S. Cl. ..... 228/144; 228/173 C; 72/421

[58] Field of Search ..... 228/142, 144, 173 B, 228/173 C; 72/329, 335, 336, 348, 347, 420, 421

[56] References Cited

U.S. PATENT DOCUMENTS

| | | | |
|---|---|---|---|
| 163,793 | 5/1875 | Martyn | 72/348 |
| 858,172 | 6/1907 | Godfrey | 72/348 X |
| 1,272,751 | 7/1918 | Winter | 72/347 |
| 3,440,711 | 4/1969 | Roper | 228/142 |

FOREIGN PATENT DOCUMENTS

| | | | |
|---|---|---|---|
| 84227 | 6/1980 | Japan | 228/142 |

*Primary Examiner*—Nicholas P. Godici
*Assistant Examiner*—P. Weston Musselman, Jr.
*Attorney, Agent, or Firm*—Cushman, Darby & Cushman

[57] ABSTRACT

A method for manufacturing a box-shaped door, which comprises the steps of cutting off the four corners of a rectangular metal blank in the square form to provide the four walls of a box body; vertically bending said cutoff four sides by a female die on whose inner wall there are provided in the stepped state an upper bending section and lower shaping section and a male die whose outer wall is shaped complementary to the inner wall of said female die; curvedly shaping the abutting edges of the corners of the four sides of the metal blank, said vertical bending and curved shaping being carried out at the same time; and welding said abutting edges to provide the box body of a box-shaped door.

2 Claims, 20 Drawing Figures

METHOD FOR MANUFACTURING A BOX-SHAPED DOOR

BACKGROUND OF THE INVENTION

This invention relates to manufacture of a box-shaped door, for example, the door of an icebox, and more particularly to a method and device for manufacturing said box-shaped door.

The body of the above-mentioned box-shaped door has generally been constructed by pressing a metal blank. However, the pressing work has the drawbacks that it is necessary to provide a die having a complicated shape and a large-scale machine has to be installed. To date, therefore, it has been proposed to carry out bending and shaping separately. In this case, too, the manufacturing equipment is accompanied with the drawbacks that a large number of dies have to be provided; and the work steps and consequently work hours increase in number, resulting in the low efficiency of said manufacturing process as a whole.

SUMMARY OF THE INVENTION

It is accordingly the object of the invention to provide a method and device for manufacturing a box-shaped door which can assure a reduction in the cost of manufacturing equipment and work expenses by effecting the bending and shaping of workpieces in a single step on a fabricating machine of simple arrangement. Further, the manufacturing device embodying this invention which can automatically locate a workpiece contributes to improvement on product quality and the elevation of manufacturing efficiency. Moreover, according to the invention, a welding process is applied which is accompanied with little residual stress, thereby improving the product quality.

The method of this invention for manufacturing a box-shaped door comprises the steps of cutting off the corner sections of a rectangular metal blank in the square form; vertically bending the four sides of the remaining metal blank to provide the rectangular side walls of the box-shaped door by means of a lower female die on the inner wall of which an upper bending section and lower shaping section are formed in the stepped state and a male die whose outer wall in shaped complementary to said bending and shaping sections of the female die; curving the mutually abutting edges of the four vertically bent sides of the metal blank to cause said edges to have a plane contact; and finally welding said mutually abutting edges of the four vertically bent sides of the metal blank.

A device embodying this invention for manufacturing a box-shaped door consists of a lower female die on whose inner wall an upper bending section and a lower shaping section are formed in the stepped state and an upper male die whose outer wall is shaped complementary to said bending and shaping sections of the female die.

DETAILED DESCRIPTION OF THE PREFERRED EMBODIMENT

Figure 1:
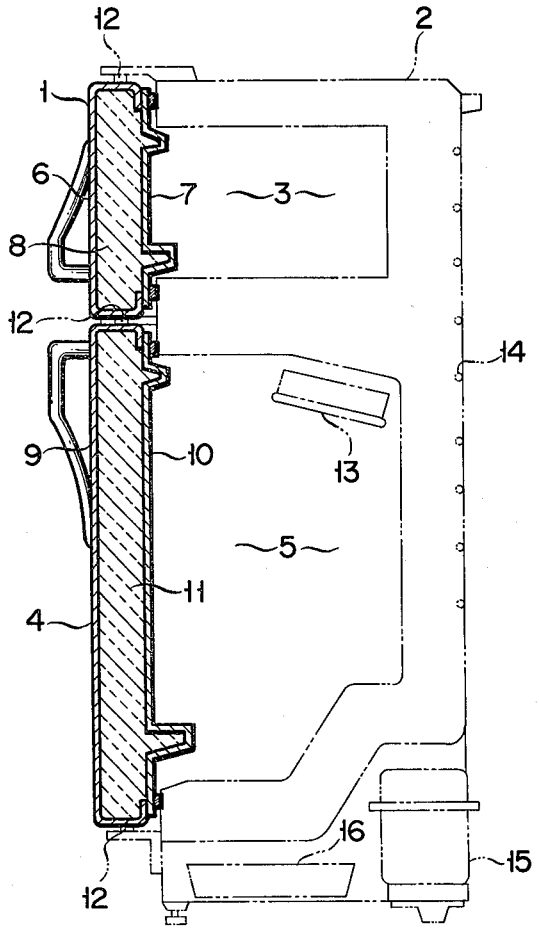
FIG. 1 is a longitudinal sectional view of the box-shaped door of an icebox to which the manufacturing method and device of this invention is applied.

Description is now given with reference to the accompanying drawings of a method and device embodying this invention for manufacturing a box-shaped door of an icebox. Referring to FIG. 1, reference numeral 1 denotes a box-shaped front door of the upper freezing chamber 3 constituting the upper section of a icebox 2. Said front door 1 consists of a box body 6, a heat-insulating material 8 prepared from, for example, foamed polyurethane resin and filled in said box body 6, and a cap 7 fitted to the backside of said front door 1. Reference numeral 4 shows a front door of a cooling chamber 5 constituting the lower section of the icebox 2. This front door 4 similarly consists of a box body 9, heat-insulating material 11 prepared similarly from foamed polyurethane resin and filled in said box body 9, and a cap 10 fitted to the backside of said box body 9. The front doors, 1, 4 are swingably supported by hinges 2. Reference numeral 13 denotes a cooling device for the cooling chamber 5; reference numeral 14 shows a condenser; reference numeral 15 is a compresser; and reference numeral 16 represents an evaporation dish.

Figure 2A:
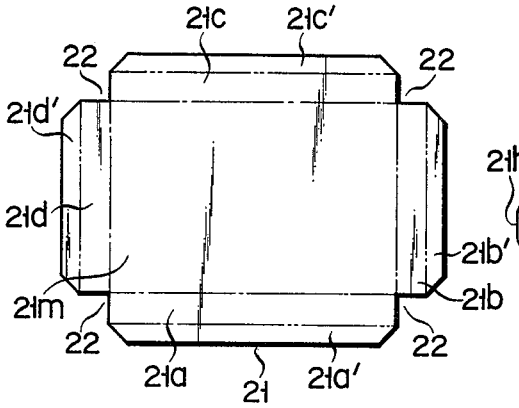
FIGS. 2A to 2F illustrate the sequential steps of manufacturing the subject box-shaped door.
Figure 2B:
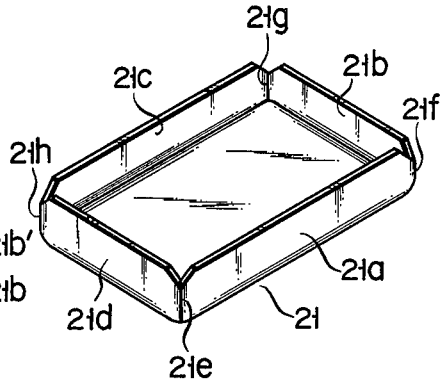
Figure 4:
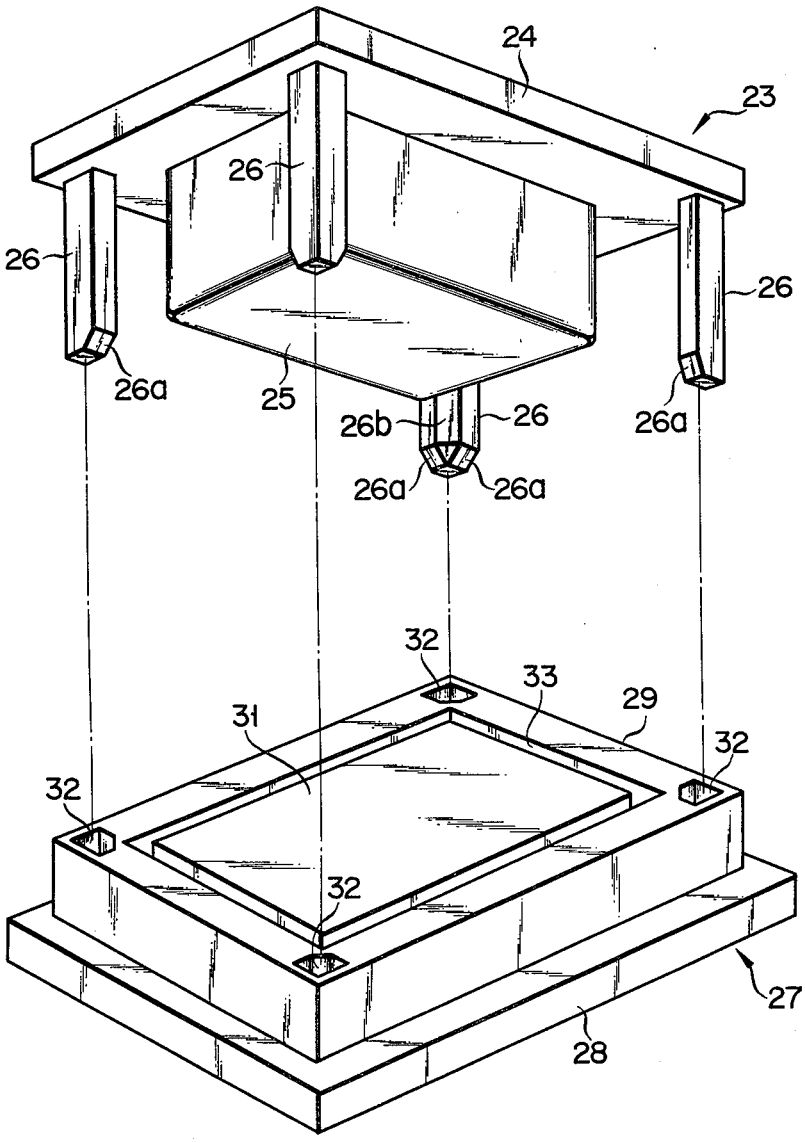
FIG. 4 is an oblique view of said bending and shaping device.
Figure 5:
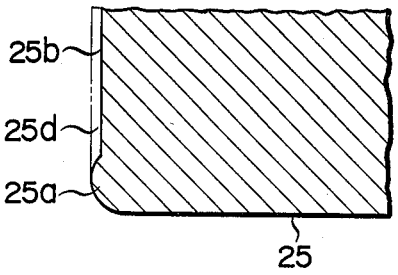
FIG. 5 is an enlarged longitudinal sectional view of one of the lower corners of a male die.
Figure 6:
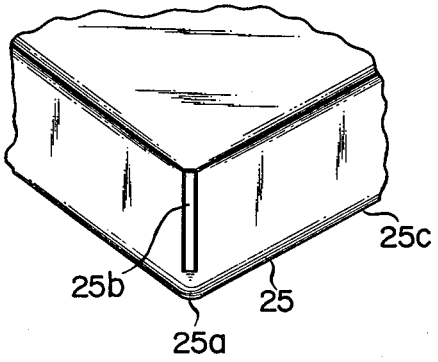
FIG. 6 is an oblique view of said lower corner.
Figure 7:
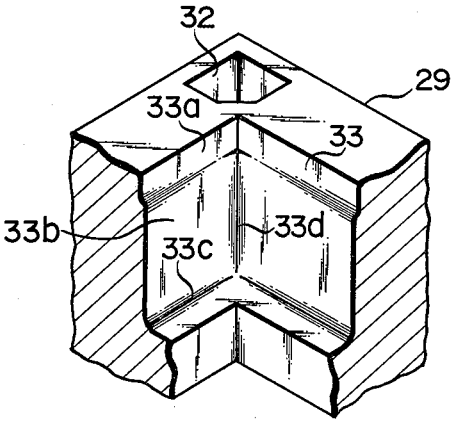
FIG. 7 is an enlarged oblique view of one of the four corners of a female die.
Figure 8:
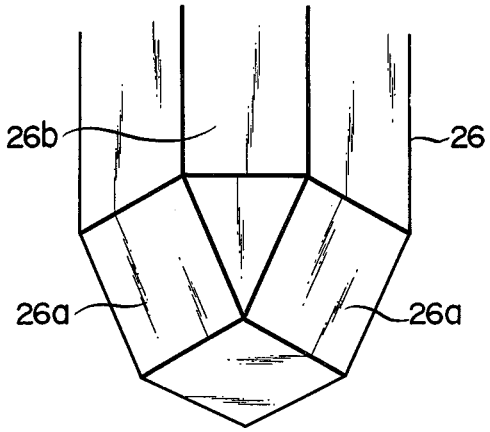
FIG. 8 is enlarged oblique view of the end section of a locating wedge.

The four corners of, for example, a rectangular steel blank 21 constituting the box body 6 of the front door 1 of the freezing chamber 3 are cut off by a press (not shown) in the form shown in FIG. 2A, thereby forming four side walls 21*a*, 21*b*, 21*c*, 21*d* of the box body 6 along the edge of the bottom wall 21*m*. The outer edge portions of said side walls 21*a*, 21*b*, 21*c*, 21*d*, are formed into four sections 21*a*′, 21*b*′, 21*c*′, 21*d*′ which are later to be bent vertically. Both ends of each of said four sections 21*a*′, 21*b*′, 21*c*′, 21*d*′, are cut off 45° in the opposite directions. A hole is bored at the required points of the metal blank 21 to allow for the fitting of a gasket, ornamental attachment or handle (not shown). As shown in FIG. 2B, the four sides 21*a* to 21*d* of the metal blank 21 are bent vertically. The abutting edge portions 21*e*, 21*f*, 21*g*, 21*h* of the four sides 21*a* to 21*d* are curvedly shaped to be mutually contacted by a plane. The above-mentioned bending and shaping are effected by a device shown in FIGS. 3 and 4. Reference numeral 23 denotes an upper male die body. A male die 25 is fixed to the central part of a rectangular upper base 24. A locating wedge 26 provided with a tapered plane 26*a* at the outer end is projectively formed at the four corners of the upper base 24. Reference numeral 27 denotes a lower female die body. A rectangular supporting plate 31 slightly smaller than the bottom wall 21*m* is mounted on the base 28 of the lower female die body 27 by springs 30, 30, thereby fixing the female die 29 whose inner wall is shaped complementary to the outer wall of the male die 25. The bottom wall of the female die 29 is bored with a hole 29*a* engageable with the supporting plate 31. A guide hole 32 into which the locating wedge 26 is inserted is formed in the four corners of the female die 29. The outer dimensions of the male die 25 and the curvature radii of the peripheral edge 25*c* of the bottom of said male die 25 and the lower end sections 25*a* of the four corners of said male die 25 are respectively chosen to be the same as the inner dimensions of the box body 6 and the curvature radius of the four corners of the inner wall thereof. As shown in FIG. 5, an escapement 25*d* is provided on the edge 25*b* extending above the lower end sections 25*a* of the four corners of said male die 25. The edge 25*b* is chosen to have a larger curvature radius than that of the lower edge of the inner wall of the box body 6. The inner wall 33 of the female die 29 comprises a bending section 33*a* for vertically bending the four sides 21*a* to 21*d* of the metal blank 21 and a shaping section 33*b* for curving the mutually abutting sections 21*e* to 21*h* of said four sides 21*a* to 21*d*. Said bending section 33*a* and shaping section 33*b* are provided in the stepped form. The inner dimensions of the shaping section 33*b* and the curvature radii of the inner bottom peripheral edge 33*c* and the four corners 33*d* both of said shaping section 33*b* are respectively chosen to be the same as the outer dimensions, and the curvature radius of the peripheral edge of said box body 6. The inner dimensions of the bending sections 33*a* is chosen to be larger than those of the shaping section 33*b*. Now let it be assumed that a metal blank 21 having a thickness of 0.5 mm is bent and shaped to provide a box body 6 whose bottom peripheral edge has a curvature radius of 5 mm and whose four side abutting edges 21*e* to 21*h* have a curvature radius of 8 mm. Then the curvature radius of the inner bottom peripheral edge 33*c* and the curvature radius of the four corners 33*d* both of said female die 29 are respectively chosen to be 5 mm and 8 mm. The curvature radius of the lower corner edge 25*a* and that of the peripheral edge 25*c* both of the male die 25 are set at 4.5 mm. The of the escapement 25*d* of the edge 25*b* of the male die 25 is chosen to be about 0.1 mm, and the curvature radius of said edge 25*b* is set at 7.8 mm. The locating wedge 26 has a square cross section. The outer end portion of said wedge 26 is provided with rectangularly intersecting tapered planes 26*a* which are used to locate the metal blank 21 by sliding along the cut portions 22 thereof. The locating wedge 26 is provided with chamfered planes 26*b* in order to widen a space defined between a guide hole 32 drilled in the female die 29 and the inner wall 33 thereof.

Figure 3:
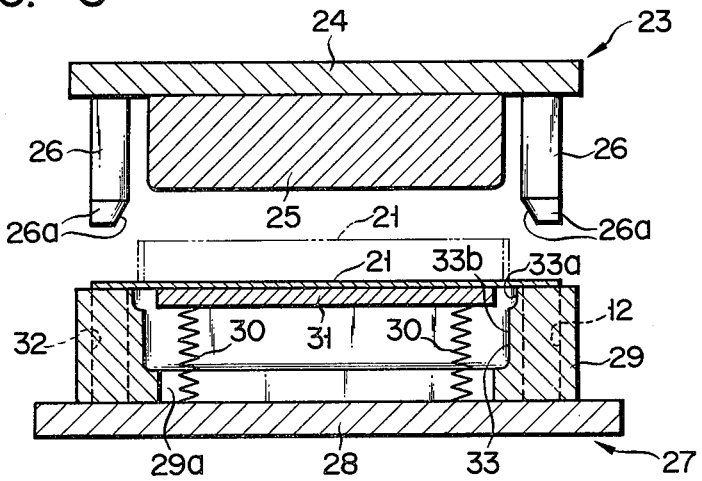
FIG. 3 is a longitudinal sectional view of a device for vertically bending the four sides of a metal blank remaining after the cutting of its four corners and curvedly shaping the mutually abutting edges of said four vertically bent sides of the metal blank.
Figure 9:
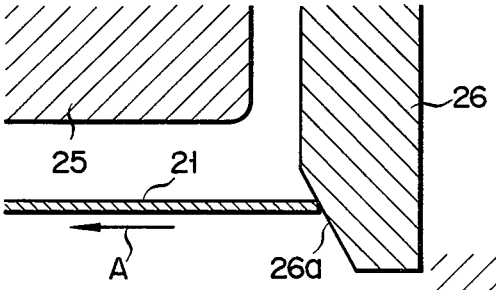
FIG. 9 is a fractional longitudinal view of the metal blank-locating wedge in operation.
Figure 10:
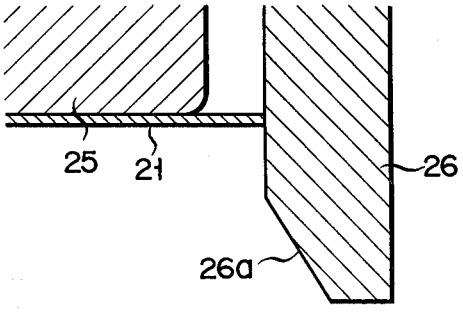
FIG. 10 is a fractional longitudinal view of the metal blank-locating wedge after the location operation is brought to an end.
Figure 11:
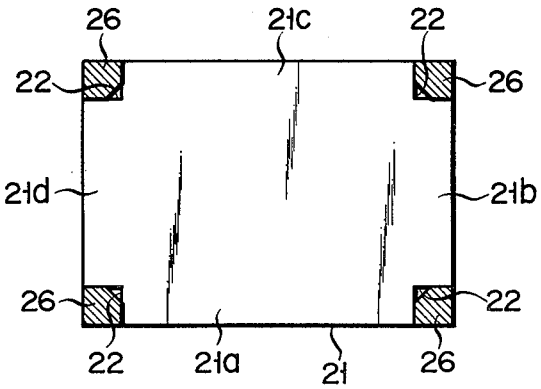
FIG. 11 is a plan view of the metal blank including four wedges after the completion of their locating operation.
Figure 12:
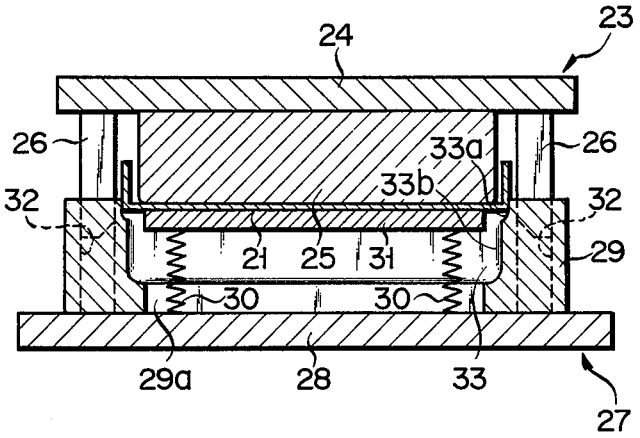
FIG. 12 is a longitudinal sectional view of the four sides of the metal blank which have been vertically bent by the bending device of FIG. 3.
Figure 13:
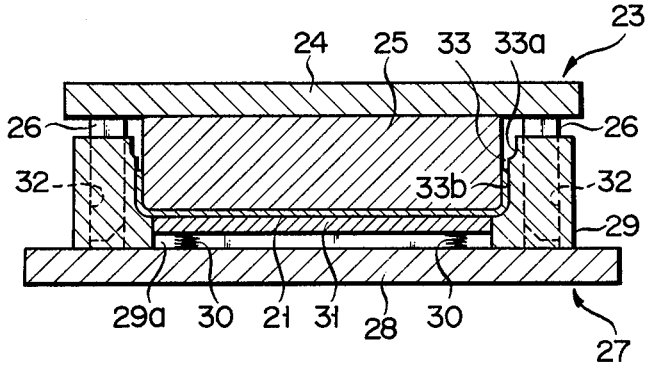
FIG. 13 is a longitudinal sectional view of the mutually facing edges of the four vertically bent sides of the metal blank which have been shaped.

As shown in FIG. 3, the metal blank 21 whose corners have been cut off is first set on the supporting plate 31 and female die 29. Under this condition, the upper male die body 23 is brought down. If, in this case, the metal blank 21 is displaced from its normal position as shown in FIG. 9, then the tapered planes 26*a* of the locating wedge 26 slidably contact the cutoff corners of the four sides of the metal blank 21 while said wedge 26 is brought into the guide hole 32. As a result, the metal blank 21 is pushed in the direction of an arrow A indicated in FIG. 9, to have its position corrected as shown in FIG. 10. Thus, the metal blank 21 is correctly set in position by four locating wedges 26 as illustrated in FIG. 11. When under this condition, the upper male die body 23 is lowered, the bottom plate 21*m* of the metal blank 21 is clamped between the supporting plate 31 supported by the springs 30 and the bottom wall of the male die 25 to remain flat. Only the four sides 21*a* to 21*d* are vertically bent as shown in FIG. 12 by the bending section 33*a* of the female die 29. When the upper male die body 23 is brought down, the mutually abutting sections 21*e* to 21*h* of the four sides 21*a* to 21*d* of the metal blank 21 are curvedly pressed by the four corners 33*d* of the shaping section 33*b* of the female die 29. As a result, the abutting edges of the four sides 21*a* to 21*d* of the metal blank 21 contact each other by a plane. Since the escapement 25*d* is provided in the four corner edges 25*b* of the male die 25, the abutting edges 21*e* to 21*h* of said four sides 21*a* to 21*d* can be neatly curved without being subjected to excess stresses. The lower edges of the four vertically bent sides 21*a* to 21*d* of the metal blank 21 are curvedly shaped by the inner bottom edge 33*c* of the female die 29 and the bottom peripheral edge 25*c* of the male die 25. The inside of the bottom wall 21*m* of the metal blank 21 which is securely held by a supporting plate 31 supported by the springs 30, 30 is little subjected to undesirable bending or deformation.

Figure 2C:
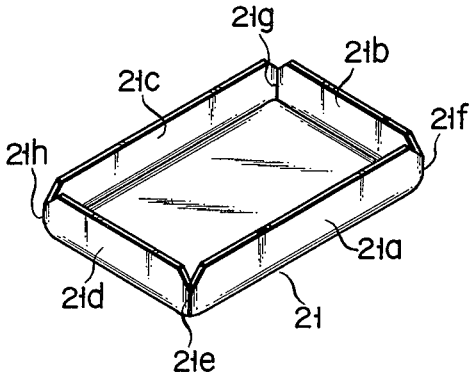
Figure 14:
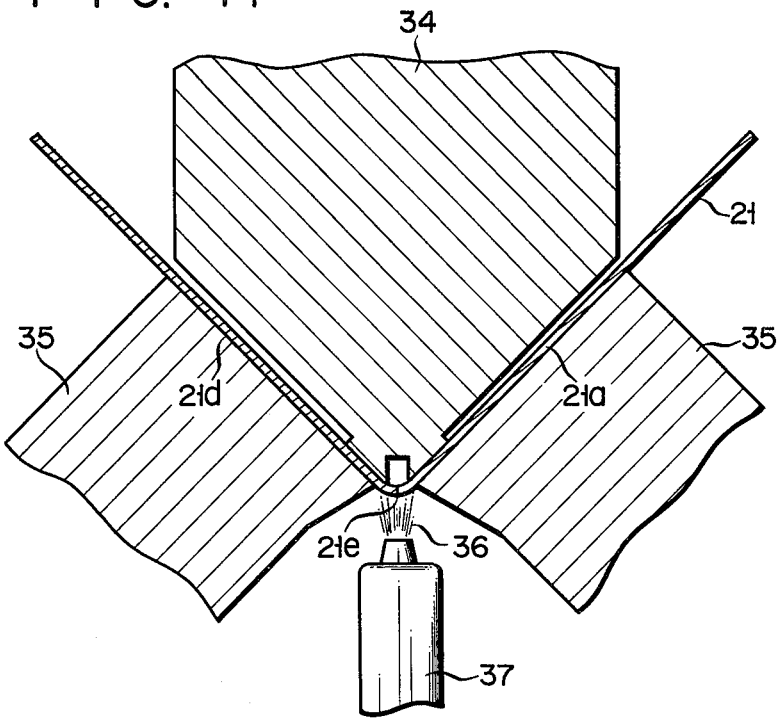
FIG. 14 is an enlarged cross sectional view of the mutually abutting edges of the four sides of the metal blank in the process of being welded.
Figure 15:
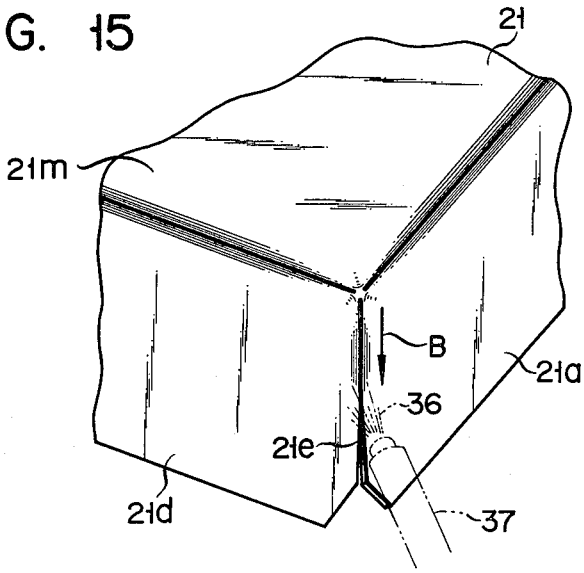
FIG. 15 is an oblique view of said mutually abutting edges in the process of being welded (showing a box body turned upside down from that of FIGS. 2A to 2F).

The abutting edges 21*e* to 21*h* of the four sides 21*a* to 21*d* of the metal blank 21 are welded together as shown in FIG. 2*c* by a welding device shown in FIG. 14. The welding device comprises one inner jig 34, two outer jigs 35, 35 and welding torch 37. This welding torch 37 is the type which ejects plasma 36 by applying, for example, an argon gas. The plasma 36 is ejected on the side walls 21*a* to 21*d* of the metal blank 21 held between the inner jig 34 and outer jigs 35, 35. The welding of the abutting edges 21*e* to 21*h* proceeds in the direction of an arrow B indicated in FIG. 15 (showing a box body turned upside down) from the bottom of the box body 6 to the open side thereof. Therefore welding can be effected while releasing excess stresses, thereby reducing strains remaining in the welded section.

Figure 2D:
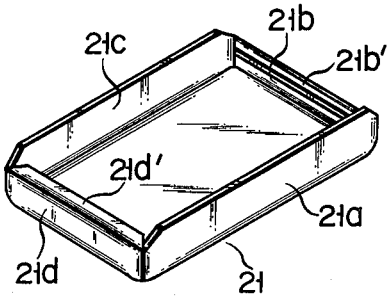
Figure 2E:
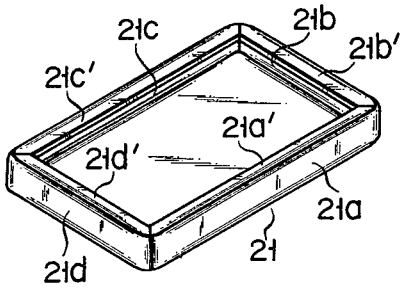
Figure 2F:
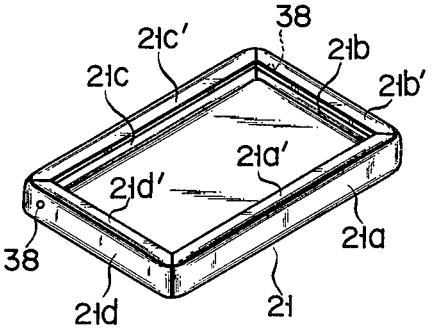

As illustrated in FIG. 2D, the upper edges 21*b*', 21*d*' of the shorter sides 21*b*, 21*d* are bent inward. As shown in FIG. 2E, the upper edges 21*a*', 21*c*', of the longer sides 21*a*, 21*c* are similarly bent inward. The planes cut off 45° at both ends of each of the inward bent upper sides 21*a*' to 21*d*' are made to abut with each other. The abutting edges welded by, for example, the spot process. Last as shown in FIG. 2F , hinge holes 38 are provided on one side of the box body 6 of the icebox door to finish the manufacture of said box body 6.

A method and device embodying this invention for manufacturing a box-shaped door comprises, as described above. The steps of cutting off the four corners of a rectangular metal blank in the square form to provide the four sides of a box-shaped door and later simultaneously carrying out the vertical bending of the four sides of the box body, and the curved shaping of the abutting edges of said four sides.

Therefore, this invention offers the advantages that a working device is far more simplified than that which have been used in the conventional press work; the number of dies and working hours can be more reduced from in the conventional device in which the vertical bending of the four sides of a metal blank and the curved shaping of the abutting edges of said four sides are carried out separately; the metal blank is automatically located when the four sides of metal blank are vertically bended, assuring the elevation of working efficiency and the improvement of a product quality; during the working process, the bottom wall of the box body is securely held by a supporting plate supported by springs and undergoes little bending on defermation; the curved shaping of the abutting edges of the four sides of the metal blank causes said edges to contact each other by a plane, assuring the neat welding of said abutting edges and improving the external appearance of the box body as a whole; and the welding of said abutting edges proceeds from the bottom to the opening of the box body, thereby reducing the residual strains of the welded sections.

What we claim is:

1. A method of manufacturing a box-shaped door comprising the steps of:

(a) selecting registerable male and female dies, said female die defining a central body cavity having interior walls defining an upper shaping section and a lower bending section, said bending section being outwardly stepped and above said shaping section when viewed in cross-section, said male die including a body forming portion and two pairs of corner posts each corner post including a pair of vertical surface oriented at right angles, inwardly beveled surface and said corner posts extending below said body forming portion;

(b) cutting a rectangular metal blank to form a substantial right angle notch in each corner, adjacent pairs of said notches thereby defining a line to establish a side wall;

(c) placing the blank having notches formed therein according to step (b) in juxtaposition with the female die so that each line establishing a side wall is substantially disposed above said bending section;

(d) centering the blank placed in juxtaposition with the female die in accordance with step (c) by advancing the male die relative to the female die, selected ones of the beveled surfaces of said corner posts contacting a portion of the notches in registry therewith to cause movement of the blank relative to others of the corner posts until the vertical surfaces of each are registered with the respective ones of said notches; and (e) forming said box-shaped door by further advancing said male die relative to said female die, the body forming portion contacting the blank centered according to step (d) so that said side walls are vertically bent along the establishing lines in the bending section of the female die to thereby establish corners of the box-shaped door and, upon continued advancement of said male die into said cavity, shaping the corners of said box-shaped door in said shaping section.

2. A method as in claim 1 further comprising the step of (f) welding the abutting edges of the side walls.

* * * * *